US005180951A

United States Patent [19]

Dworsky et al.

[11] Patent Number: 5,180,951

[45] Date of Patent: Jan. 19, 1993

[54] ELECTRON DEVICE ELECTRON SOURCE INCLUDING A POLYCRYSTALLINE DIAMOND

[75] Inventors: Lawrence N. Dworsky; James E. Jaskie; Robert C. Kane, all of Scottsdale, Ariz.

[73] Assignee: Motorola, Inc., Schaumburg, Ill.

[21] Appl. No.: 831,592

[22] Filed: Feb. 5, 1992

[51] Int. Cl.[5] ..... H05B 41/00

[52] U.S. Cl. ..... 315/169.3; 315/169.4; 313/311; 313/329; 313/346 R; 313/355

[58] Field of Search ..... 315/167, 169.3, 169.4, 315/324, 326, 334, 349; 313/446, 450, 309, 310, 311, 329, 336, 346 R, 351, 355

[56] References Cited

PUBLICATIONS

Sharma, S. C. et al., "Deposition of Diamond Films at Low Pressures and Their Characterization by Position Annihilation, Raman, Scanning Electron Microscopy, and X-Ray Photoelectron Spectroscopy", *Applied Physics Letters,* vol. 56; No. 18; 30 Apr. 1990, pp. 1781-1783.

Yoshikawa, M. et al., "Characterization of Crystaline Quality of Diamond Films by Raman Spectroscopy", *Applied Physics Letters;* vol. 55, No. 25, 18 Dec. 1989; pp. 2608-2610.

Buckley, R. G. et al.; "Characterization of Filament-Assisted Chemical Vapor Deposition Diamond Films Using Raman Spectroscopy", *Journal of Applied Physics;* vol. 66; No. 8; 15 Oct. 1989; pp. 3595-3599.

*Primary Examiner*—David Mis

*Attorney, Agent, or Firm*—Eugene A. Parsons

[57] ABSTRACT

An electron device employing an electron source including a polycrystalline diamond film having a surface with a plurality of crystallographic planes some of which exhibit a very low/negative electron affinity such as, for example, the 111 crystallographic plane of type II-B diamond. Electron devices employing such electron sources are described including image generation electron devices, light source electron devices, and information signal amplifier electron devices.

20 Claims, 8 Drawing Sheets

43

53

ELECTRON DEVICE ELECTRON SOURCE INCLUDING A POLYCRYSTALLINE DIAMOND

FIELD OF THE INVENTION

The present invention relates generally to electron emitters and more particularly to polycrystalline diamond film electron emitters.

BACKGROUND OF THE INVENTION

Electron devices employing free space transport of electrons are known in the art and commonly utilized as information signal amplifying devices, video information displays, image detectors, and sensing devices. A common requirement of this type of device is that there must be provided, as an integral part of the device structure, a suitable source of electrons and a means for extracting these electrons from the surface of the source.

A first prior art method of extracting electrons from the surface of an electron source is to provide sufficient energy to electrons residing at or near the surface of the electron source so that the electrons may overcome the surface potential barrier and escape into the surrounding free-space region. This method requires an attendant heat source to provide the energy necessary to raise the electrons to an energy state which overcomes the potential barrier.

A second prior art method of extracting electrons from the surface of an electron source is to effectively modify the extent of the potential barrier in a manner which allows significant quantum mechanical tunneling through the resulting finite barrier. This method requires that very strong electric fields must be induced at the surface of the electron source.

In the first method the need for an attendant energy source precludes the possibility of effective integrated structures in the sense of small sized devices. Further, the energy source requirement necessarily reduces the overall device efficiency since energy expended to liberate electrons from the electron source provides no useful work.

In the second method the need to establish very high electric fields, on the order of $1\times10^7$V/cm, results in the need to operate devices by employing objectionably high voltages or by fabricating complex geometry structures.

Accordingly there exists a need for electron devices employing an electron source which overcomes at least some of the shortcomings of the electron sources of the prior art.

SUMMARY OF THE INVENTION

This need and others are substantially met through provision of an electron device electron source including a polycrystalline diamond film having a surface comprising a plurality of crystallographic planes some of which exhibit an inherent affinity to retain electrons disposed at/near the surface which is less than 1.0 electron volt.

This need and others are further met through provision of an electron device including a polycrystalline diamond film having a surface comprising a plurality of crystallographic planes some of which exhibit a very low affinity to retain electrons disposed at/near the surface and an anode distally disposed with respect to the surface and adapted to have a voltage source coupled between the anode and polycrystalline diamond film resulting in electron emission from crystallographic planes of the plurality of crystallographic planes exhibiting very low electron affinity which electron emission is substantially uniform and preferentially collected at the anode.

In a first embodiment of an electron device utilizing an electron source in accordance with the present invention a substantially uniform light source is provided.

In another embodiment of an electron device utilizing an electron source in accordance with the present invention an image display device is provided.

In yet other embodiments of electron devices employing electron sources in accordance with the present invention signal amplifying devices are provided.

DETAILED DESCRIPTION OF THE PREFERRED EMBODIMENTS

Figure 1:
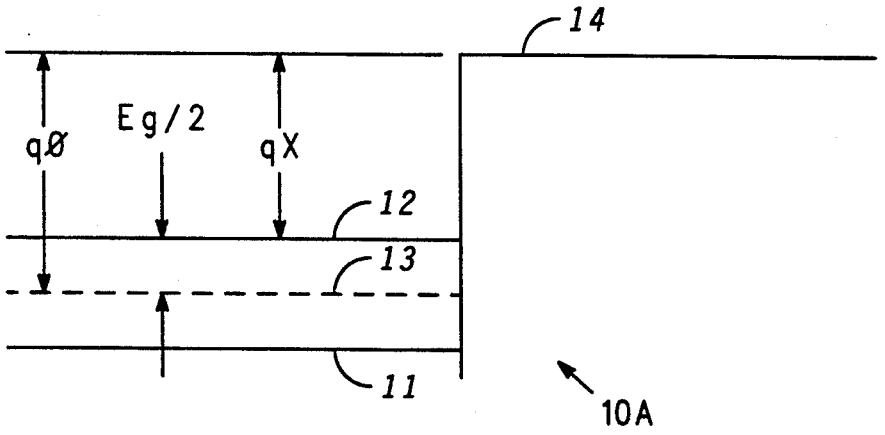
FIGS. 1 and 2 are schematical depictions of typical semiconductor to vacuum surface energy barrier representations.

Referring now to FIG. 1 there is shown a schematical energy barrier representation of a semiconductor to vacuum interface 10A. The semiconductor material surface characteristic is detailed as an upper energy level 11 of a valance band, a lower energy level 12 of a conduction band and an intrinsic Fermi energy level 13 which typically resides midway between upper level 11 of the valance band and lower level 12 of the conduction band. A vacuum energy level 14 is shown in relation to the energy levels of the semiconductor material wherein the disposition of vacuum energy level 14 at a higher level than that of the semiconductor energy levels indicates that energy must be provided to electrons disposed in the semiconductor material in order that such electrons may possess sufficient energy to overcome the barrier which inhibits spontaneous emission from the surface of the material into the vacuum space.

For semiconductor system 10A, the energy difference between vacuum energy level 14 and lower level 12 of the conduction band is referred to as the electron affinity, $q\chi$. The difference in energy levels between lower level 12 of the conduction band and upper energy level 11 of the valance band is generally referred to as the band-gap, Eg. In the instance of undoped (intrinsic) semiconductor the distance from intrinsic Fermi energy level 13 to lower energy level 12 of the conduction band is one half the band-gap Eg/2. As shown in the depiction of FIG. 1, it will be necessary to augment the energy content of an electron disposed at lower energy level 12 of the conduction band to raise it to an energy level corresponding to free-space energy level 14.

A work function, $q\phi$, is defined as the average energy which must be added to an electron so that the electron may overcome the surface potential barrier to escape the surface of the material in which it is disposed.

For interface 10A of FIG. 1, $$q\phi = q\chi + Eg/2$$

Figure 2:
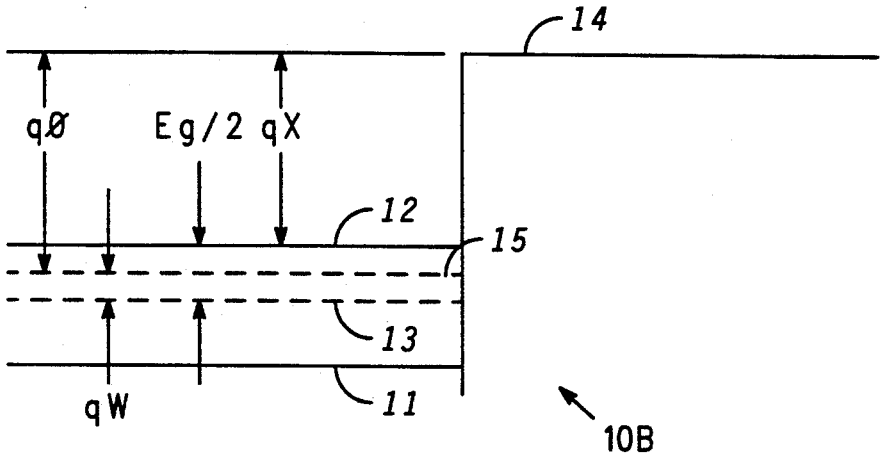

FIG. 2 is a schematical energy barrier representation of a semiconductor to vacuum interface 10B as described previously with reference to FIG. 1 wherein the semiconductor material depicted has been impurity doped in a manner which effectively shifts the energy levels such that a Fermi energy level 15 is realized at an energy level higher than that of intrinsic Fermi energy level 13. This shift in energy levels is depicted by an energy level difference, $q\omega$, which yields a corresponding reduction in the work function of the system.

For interface 10B of FIG. 2, $$\phi = q\chi + Eg/2 - \chi$$

Clearly, although the work function is reduced the electron affinity, $q\chi$, remains unchanged by modifications to the semiconductor material.

Figure 3:
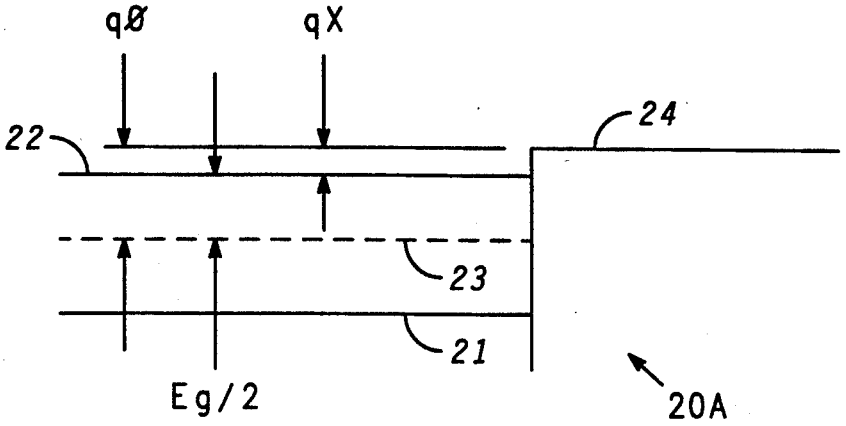
FIGS. 3 and 4 are schematical depictions of reduced electron affinity semiconductor to vacuum surface energy barrier representations.

FIG. 3 is a schematical energy barrier representation of a semiconductor to vacuum interface 20A as described previously with reference to FIG. 1 wherein reference designators corresponding to identical features depicted in FIG. 1 are referenced beginning with the numeral "2". Interface 20A depicts a semiconductor material wherein the energy levels of the semiconductor surface are in much closer proximity to a vacuum energy level 24 than that of the previously described system. Such a relationship is realized in the crystallographic 100 plane of diamond. In the instance of diamond semiconductor it is observed that the electron affinity, $q\chi$, is less than 1.0 eV (electron volt). For interface 20A in FIG. 3, $$q\phi = Eg/2 + q\chi$$

Figure 4:
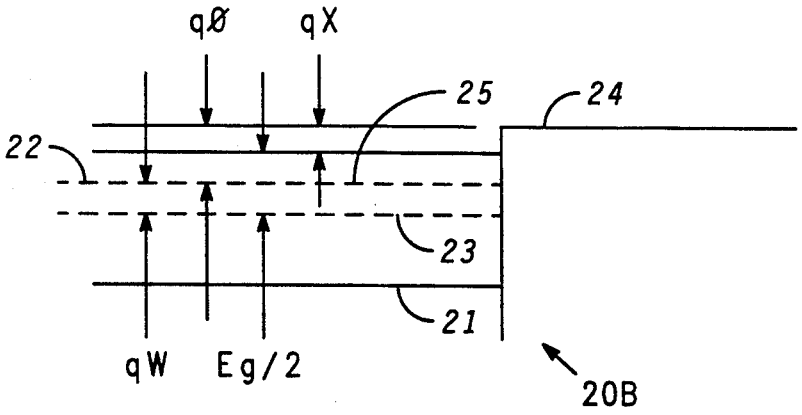

Referring now to FIG. 4 there is depicted an energy barrier representation of a semiconductor to vacuum interface 20B as described previously with reference to FIG. 3 wherein the semiconductor system has been impurity doped such that an effective Fermi energy level 25 is disposed at an energy level higher than that of intrinsic Fermi energy level 23.

For interface 20B of FIG. 4, $$q\phi = Eg/2 - q\chi + q\chi$$

Figure 5:
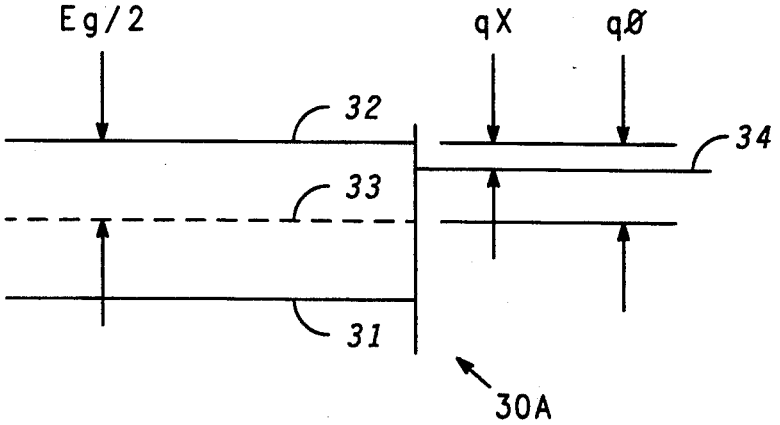
FIGS. 5 and 6 are schematical depictions of negative electron affinity semiconductor to vacuum surface energy barrier representations.

FIG. 5 is a schematical energy barrier representation of a semiconductor to vacuum interface 30A as described previously with reference to FIG. 1 wherein reference designators corresponding to identical features depicted in FIG. 1 are referenced beginning with the numeral "3". Interface 30A depicts a semiconductor material system having an energy level relationship to a vacuum energy level 34 such that an energy level of a lower energy level 32 of the conduction band is higher than an energy level of vacuum energy level 34. In such a system electrons disposed at/near the surface of the semiconductor and having energy corresponding to any energy state in the conduction band will be spontaneously emitted from the surface of the semiconductor. This is typically the energy characteristic of the 111 crystallographic plane of diamond.

For interface 30A of FIG. 5, $$q\phi = Eg/2$$

since an electron must still be raised to the conduction band before it is subject to emission from the semiconductor surface.

Figure 6:
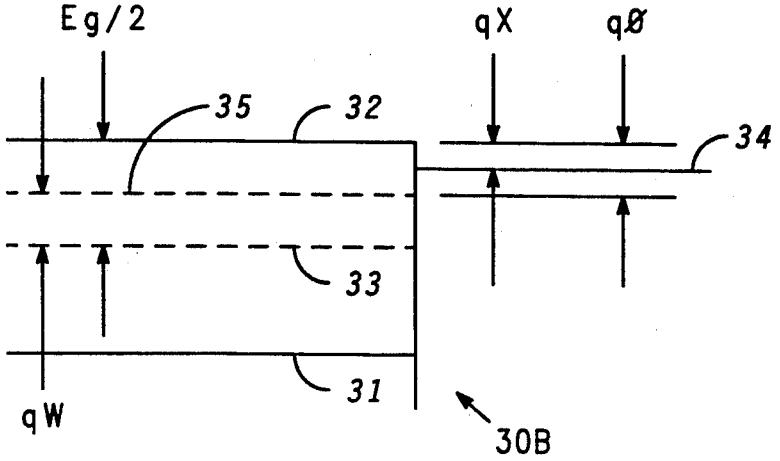

FIG. 6 is a schematical energy barrier representation of a semiconductor to vacuum interface 30B as described previously with reference to FIG. 5 wherein the semiconductor material has been impurity doped as described previously with reference to FIG. 4.

For interface 30B of FIG. 6, $$q\phi = Eg/2 - q\omega$$

For the electron device electron source under consideration in the present disclosure electrons disposed at/near the surface of polycrystalline diamond semiconductor will be utilized as a source of electrons for electron device operation. As such it is necessary to provide a means by which emitted electrons may be replaced at the surface by electrons from within the semiconductor bulk. This is found to be readily accomplished in the instance of type II-B diamond since the electrical conductivity of intrinsic type II-B diamond, on the order of 50Ωcm, is suitable for many applications. For those applications wherein the electrical conductivity must be increased above that of intrinsic type II-B diamond suitable impurity doping may be provided. Intrinsic type II-B diamond employing the 111 crystallographic plane as an electron emitting surface is unique among materials in that it possesses both a negative electron affinity and a high intrinsic electrical conductivity.

Recent developments in the art of forming polycrystalline diamond thin film disposed on various substrates is supported in the available literature. As a first example, incorporated herein by reference, in Deposition of Diamond Films at low pressures and their characterization by position annihilation. Raman scanning electron microscopy, and x-ray photoelectron spectroscopy, Sharma et al, Applied Physics Letters, Vol. 56, 30 Apr. 1990 Pp. 1781–1783, the authors describe and illustrate (FIG. 4) a diamond film comprised of a plurality of diamond crystallites which provides a polycrystalline diamond structure. As a second example, incorporated herein by reference, in Characterization of crystalline quality of diamond films by Raman spectroscopy, Yoshi Kawa, et al, Applied Physics Letters, Vol. 55, 18 Dec. 1989, Pp. 2608–2610, the authors describe and illustrate (FIG. 1) a diamond film comprised of a plurality of diamond crystallites which provides a polycrystalline diamond structure. As a third example, incorporated herein by reference, in Characterization of filament-assisted chemical vapor deposition diamond films using Raman spectroscopy, Buckley, et al, Journal of Applied Physics Vol 66, 15 Oct. 1989, Pp. 3595-3599, the authors describe and illustrate (FIG. 8) a diamond film comprised of a plurality of diamond crystallites which provides a polycrystalline diamond structure. Clearly, it is established in the art that polycrystalline diamond films are realizable and may be formed on a variety of supporting substrates such as, for example silicon, molybdenum, copper, tungsten, titanium, and various carbides.

Polycrystalline diamond films, such as those which may be realized by methods detailed in the above referenced art, provide a surface comprised of a plurality of crystallite planes each of which corresponds to a single crystallite of the plurality of crystallites of which the polycrystalline film is comprised. This plurality of crystallite planes inherently exhibits at least some density of crystallite planes oriented such that the 111 diamond crystal plane is exposed.

Figure 7:
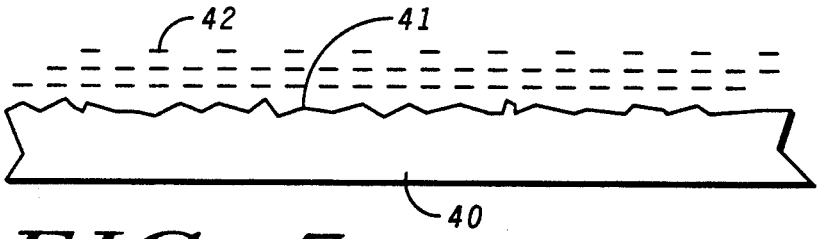
FIGS. 7 and 8 are schematical depictions of structures which are utilized in an embodiment of an electron device employing reduced/negative electron affinity electron sources in accordance with the present invention.

FIG. 7 is a side-elevational cross-sectional representation of an electron source 40 in accordance with the present invention comprising a polycrystalline diamond semiconductor material having a surface 41 including a plurality of diamond crystallite crystallographic planes some of which correspond to the 111 crystallographic plane and wherein any electrons 42 spontaneously emitted from the surface of the polycrystalline diamond material and more particularly from the 111 crystallographic planes exposed at the surface 41 reside in a charge cloud immediately adjacent to the surface 41. In equilibrium, electrons are liberated from the surface of the semiconductor at a rate equal to that at which electrons are re-captured by the semiconductor surface. As such, no net flow of charge carriers takes place within the bulk of the semiconductor material.

Figure 8:
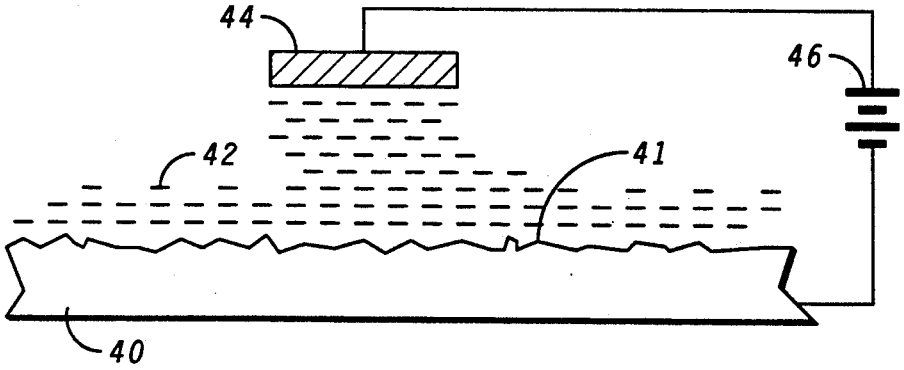

FIG. 8 is a side-elevational cross-sectional representation of an embodiment of an electron device 43 employing polycrystalline diamond film electron source 40 in accordance with the present invention as described previously with reference to FIG. 7. Device 43 further includes an anode 44, distally disposed with respect to the polycrystalline diamond film electron source 40. An externally provided voltage source 46 is operably coupled between anode 44 and electron source 40.

By employing voltage source 46 to induce an electric field in the intervening region between anode 44 and electron source 40, electrons 42 residing above surface 41 of polycrystalline diamond film electron source 40 move toward and are collected by anode 44. As the density of electrons 42 disposed above electron source 40 is reduced due to movement toward anode 44, the equilibrium condition described earlier is disturbed. In order to restore equilibrium, additional electrons are emitted from the surface of electron source 40 which electrons must be replaced at the surface 41 by available electrons within the bulk of the material. This gives rise to a net current flow within the semiconductor material of polycrystalline diamond film electron source 40 which is facilitated by the high electrical conductivity characteristic of type II-B diamond.

In the instance of type II-B diamond semiconductor employing the surface corresponding to the 111 crystallographic plane only a very small electric field need be provided to induce electrons 42 to be collected by anode 44. This electric field strength may be on the order of 1.0KV/cm, which corresponds to 1 volt when anode 44 is disposed at a distance of 1 micron with respect to polycrystalline diamond film electron source 40. Prior art techniques, employed to provide electric field induced electron emission from materials typically require electric fields greater than 10MV/cm.

Figure 9:
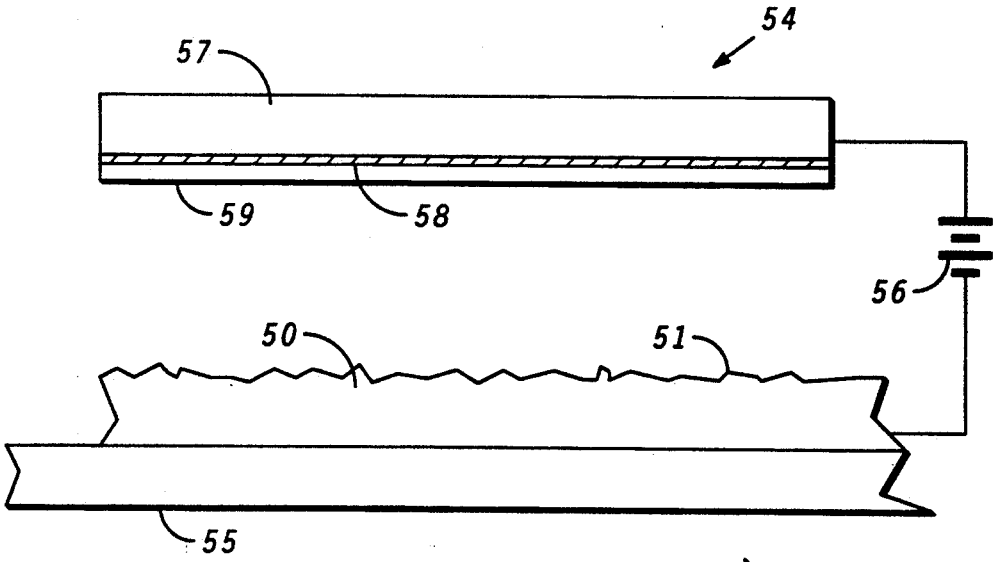
FIG. 9 is a schematical depiction of another embodiment of an electron device which is realized by employing a reduced/negative electron affinity electron source in accordance with the present invention.

FIG. 9 is a side-elevational cross-sectional depiction of another embodiment of an electron device 53 employing a polycrystalline diamond film electron source 50 in accordance with the present invention. A supporting substrate 55 having a first major surface is shown whereon polycrystalline diamond film electron source 50 is disposed. Source 50 has an exposed surface 51 exhibiting a plurality of randomly oriented exposed diamond crystallite planes some of which exhibit a low/negative electron affinity (less than 1.0eV/ less than 0.0eV). An anode 54 is distally disposed with respect to polycrystalline diamond film electron source 50. Anode 54 includes substantially optically transparent faceplate material 57 on which is disposed a substantially optically transparent conductive layer 58 having disposed thereon a layer 59 of cathodoluminescent material for emitting photons. An externally provided voltage source 56 is coupled to conductive layer 58 of anode 54 and to polycrystalline diamond film electron source 50 in such a manner that an induced electric field in the intervening region between anode 54 and polycrystalline diamond film electron source 50 gives rise to electron emission from those exposed crystallite planes which exhibit a low/negative electron affinity such as, for example the 111 crystallographic plane.

Since a polycrystalline diamond film realized by techniques known in the art may be preferentially formed with a very large number of small crystallites, each on the order of a few microns or less, electron emitters including polycrystalline diamond films provide substantially uniform electron emission as the preferentially exposed low/negative electron affinity crystallite planes are substantially uniformly, randomly distributed throughout the extent of the exposed surface with finite probability. Electrons moving through the induced electric field acquire additional energy and strike layer 59 of cathodoluminescent material. The electrons impinging on layer 59 of cathodoluminescent material give up this excess energy, at least partially, and radiative processes which take place in the cathodoluminescent material yield photon emission through substantially optically transparent conductive layer 58 and substantially optically transparent faceplate material 57.

Electron device 53 employing polycrystalline diamond film electron source 50 in accordance with the present invention provides a substantially uniform light source as a result of substantially uniform electron emission from polycrystalline diamond film electron source 50.

Figure 10:
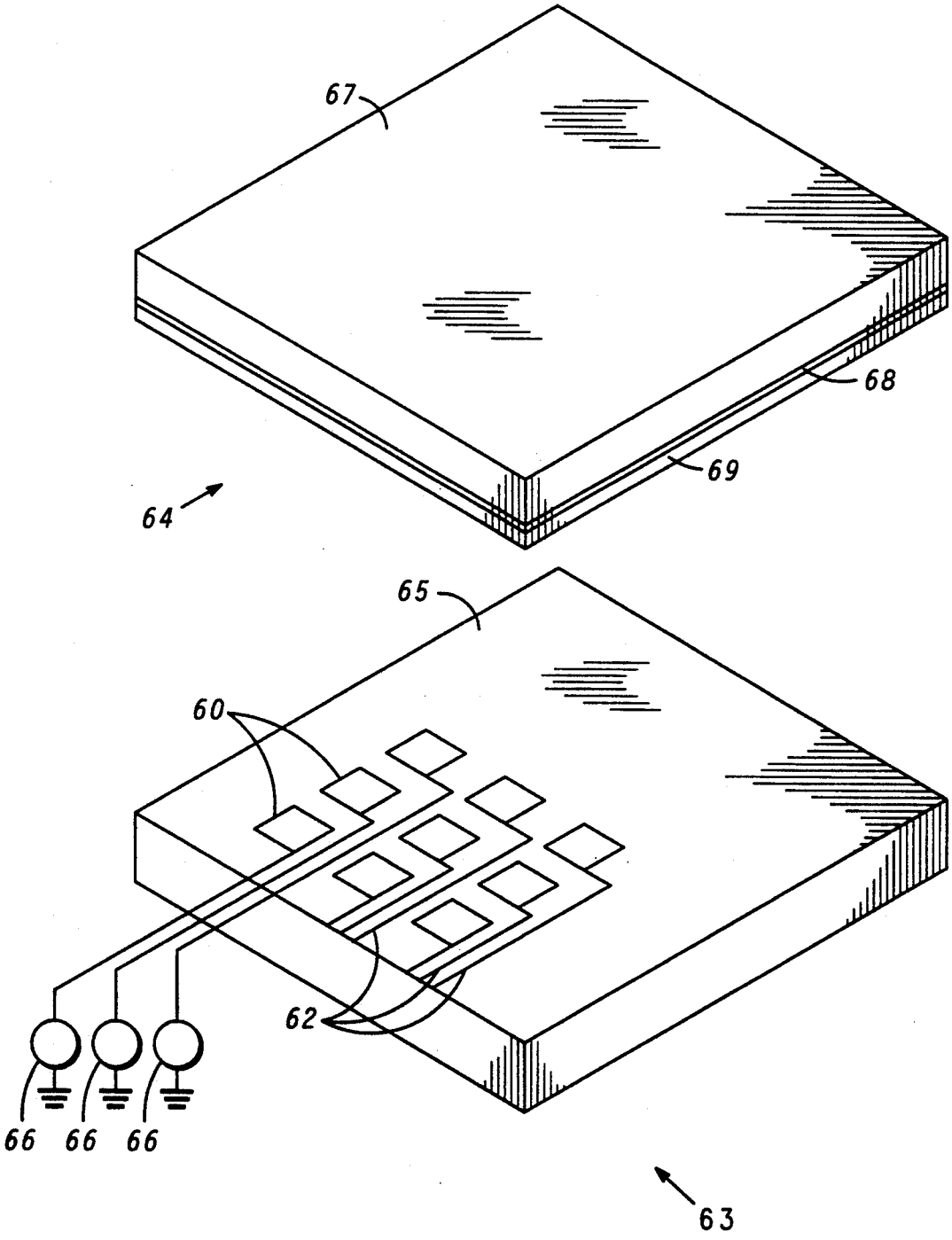
FIG. 10 is a perspective view of a structure employing a plurality of reduced/negative electron affinity electron sources in accordance with the present invention.

FIG. 10 is a perspective view of an electron device 63 in accordance with the present invention as described previously with reference to FIG. 9 wherein reference designators corresponding to features depicted in FIG. 9 are referenced beginning with the numeral "6". Device 63 includes a plurality of polycrystalline diamond film electron sources 60 disposed on a major surface of a supporting substrate 65 such as, for example, a silicon or metallic substrate. A plurality of conductive paths 62 coupled to the plurality of electron sources 60 are also disposed on the major surface of substrate 65. By forming electron sources 60 of polycrystalline type II-B diamond film having an exposed surface whereon a plurality of randomly oriented crystallite planes are exposed some of which include the 111 crystallographic plane the polycrystalline diamond film electron sources 60 function as negative electron affinity electron sources as described previously with reference to FIGS. 5, 6, and 9.

By employing an externally provided voltage source (not shown) as described previously with reference to FIG. 9 and by connecting externally provided signal sources 66 to the plurality of conductive paths 62, each of the plurality of polycrystalline diamond film electron sources 60 may be independently selected to emit electrons. For example, a positive voltage, with respect to a reference potential, is provided at conductive layer 68 such that the potential of the plurality of polycrystalline diamond film electron sources 60 is less positive with respect to the reference potential than the potential applied to conductive layer 68. Thus, an electric field of correct magnitude and polarity is provided at/near the surface of polycrystalline diamond film electron sources 60 and electrons flow to the anode. However, if externally provided signal sources 66, coupled to any of the plurality of polycrystalline diamond film electron sources 60 are of such magnitude and polarity as to cause the associated electric field at/near the exposed surface of electron source 60 to be less than that required to induce electron transit, then that particular electron source 60 will not emit electrons to anode 64.

In this manner the plurality of polycrystalline diamond film electron sources 60 is selectively addressed to emit electrons. Since the induced electric field in the intervening region between anode 64 and plurality of electron sources 60 is substantially uniform and parallel to the transit path of emitted electrons, the electrons are collected at anode 64 over an area of layer 69 of cathodoluminescent material corresponding to the area of the electron source from which they were emitted. In this manner selective electron emission results in selected portions of layer 69 of cathodoluminescent material being energized to emit photons which in turn provides an image which may be viewed through faceplate material 67 as described previously with reference to FIG. 9.

Figure 11:
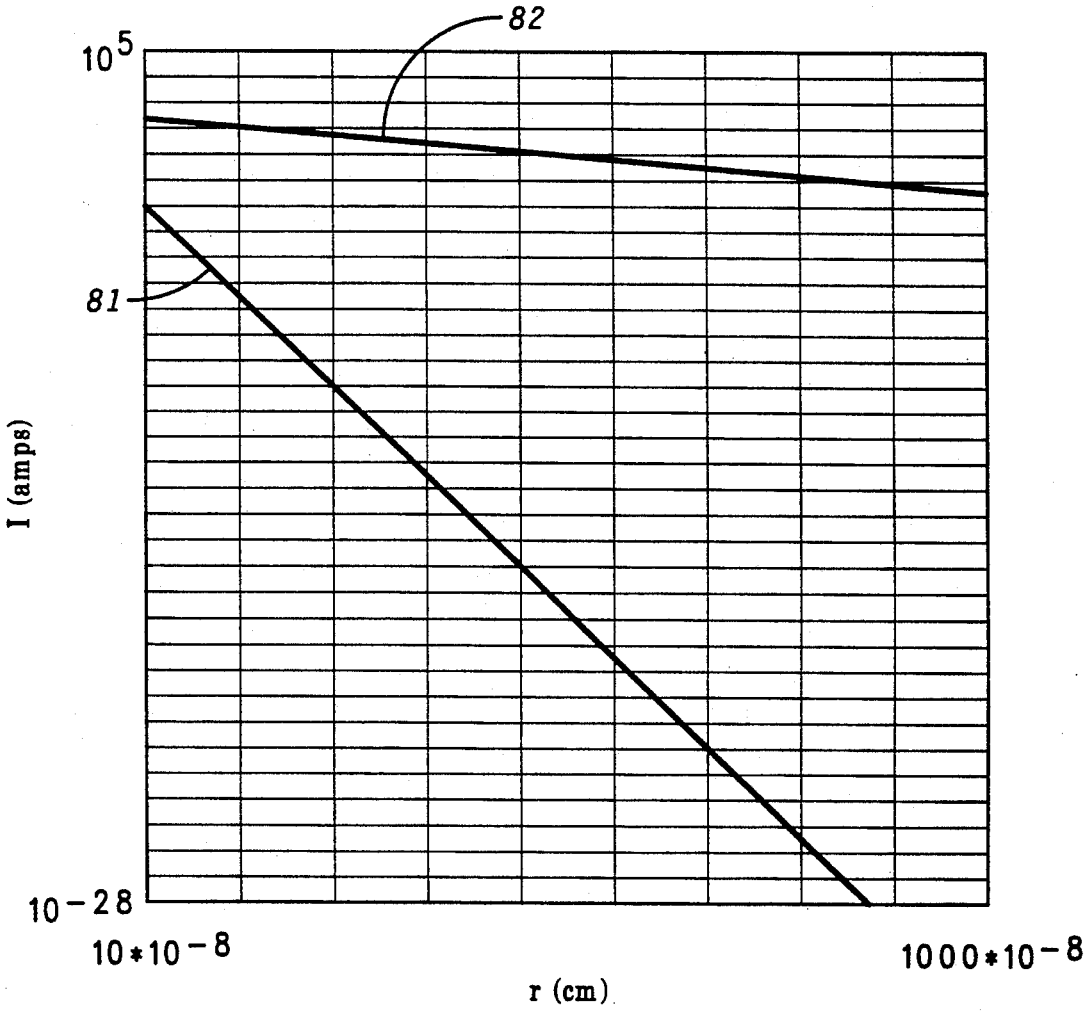
FIG. 11 is a graphical depiction of electric field induced electron emission current vs. emission radius of curvature.

FIG. 11, illustrates a graphical representation of the relationship between electric-field induced electron emission to radius of curvature of an electron source. It is known in the art that for electron sources in general, such as, for example, conductive tips/edges, an externally provided electric field is enhanced (increased) in the region of a geometric discontinuity of small radius of curvature. Further, the functional relationship for emitted electron current, $$I(r,\phi V)=1.54\times10^{-6}\times\alpha(r)\times\beta(r)^2\times V^2/(1.1\times q\phi)\ x$$
$$\{-6.83\times10^7\times(q\phi)3/2/$$
$$(\alpha=V)\times[0.95-1.44\times10^7\times\beta(r)\times V/(q\phi)^2]\}$$

where $\beta(r)=1/r$ $\alpha(r)=r^2$ and r is given in centimeters includes the parameter, $q\phi$, described previously with reference to FIG. 1 as the surface work function.

Figure 12:
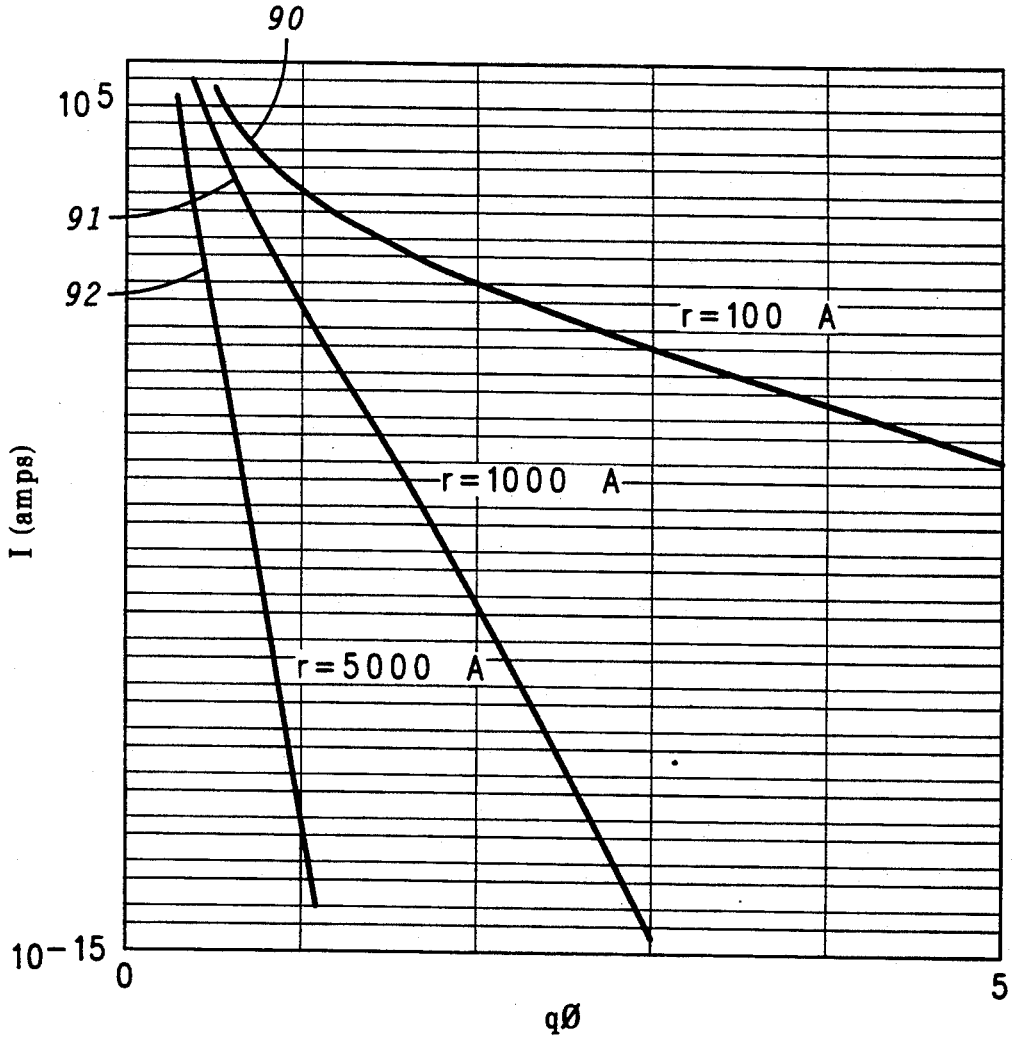
FIG. 12 is a graphical depiction of electric field induced electron emission current vs. surface work function.

FIG. 11 shows two plots of the electron emission to radius of curvature. The first plot 80 is determined setting the work function, $q\phi$, to 5eV. The second plot 82 is determined by setting the work function, $q\phi$, to 1eV. In both plots 80 and 82 the voltage, V, is set at 100 volts for convenience. The purpose of the graph of FIG. 12 is to illustrate the relationship of emitted electron current, not only to the radius of curvature of an electron source, but also to the surface work function. Clearly, it may be observed that the second plot 82 exhibits electron currents approximately thirty orders of magnitude greater than is the case with the first plot 80 when both are considered at a radius of curvature of 1000Å ($1000\times10^{-10}$m). This relationship, when applied to realization of electron source structures translates directly to a significant relaxation of the requirement that sources exhibit at least some feature of very small radius of curvature. It is shown in FIG. 11 that the electron current of the second plot 82 which employs an electron source with a radius of curvature of 1000Å is still greater than the electron current of the first plot 80 which employs an electron source with a radius curvature of only 10Å.

FIG. 12 is a graphical representation of an alternative way to view the electron current. In FIG. 12 the electron current is plotted vs. work function, $q\phi$, with the radius of curvature, r, as a variable parameter. A first plot 90 depicts the electron current vs work function for an emitter structure employing a feature with 100Å radius of curvature. Second and third plots 91 and 92 depict electron current vs work function for electron sources employing features with 1000Å and 5000Å radius of curvature respectively. For each of the plots 90, 91 and 92 it is clearly shown that electron emission increases significantly as work function is reduced and as radius of curvature is reduced. Note also, as with the plots of FIG. 11, that the current relationship is strongly affected by the work function in a manner which permits a significant relaxation of the requirement that electric field induced electron sources should have a feature exhibiting a geometric discontinuity of small radius of curvature.

Figure 13:
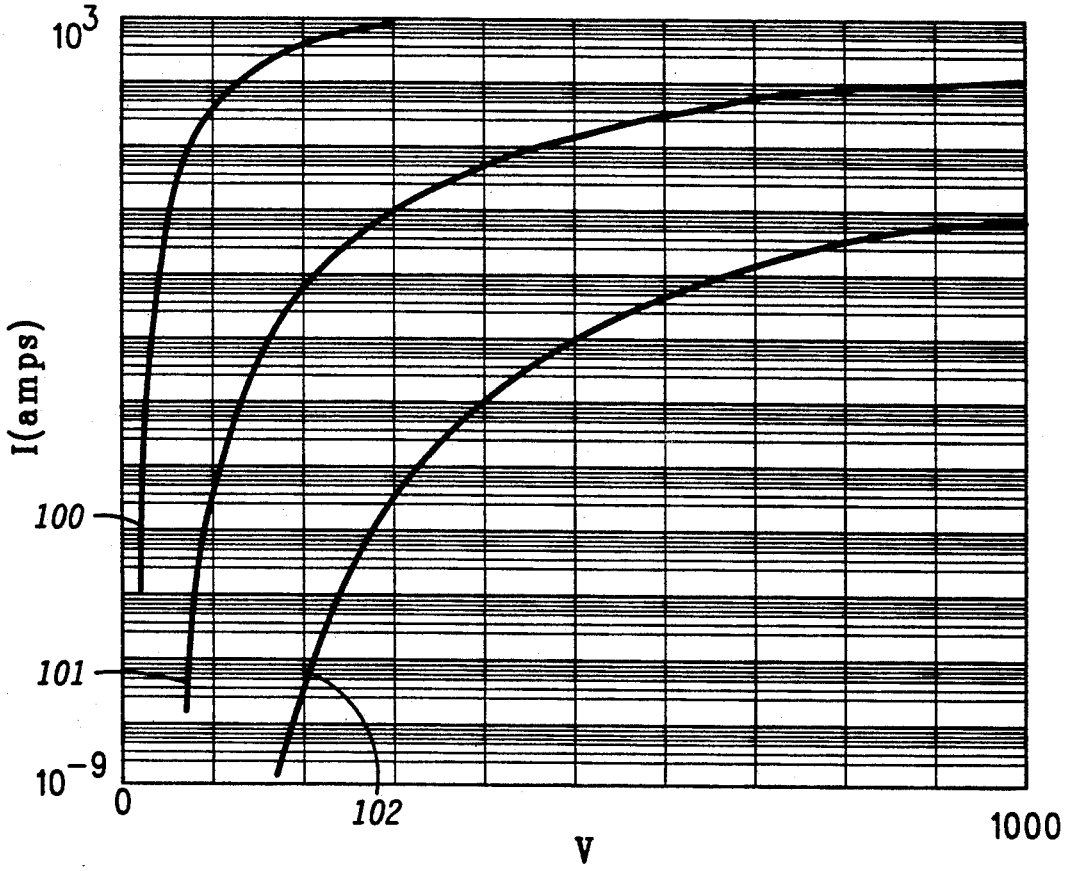
FIGS. 13 and 14 are graphical depictions of electric field induced electron emission current vs. applied voltage with surface work function as a variable parameter.

FIG. 13 illustrates a graphical representation of electron current vs applied voltage, V, with surface work function, $q\phi$, as a variable parameter. First, second, and third plots 100, 101 and 102, corresponding to work functions of 1eV, 2.5eV, and 5eV respectively, illustrate that as the work function is reduced the electron current increases by many orders of magnitude for a given voltage. This depiction is consistent with depictions described previously with reference to FIGS. 11 and 12.

Figure 14:
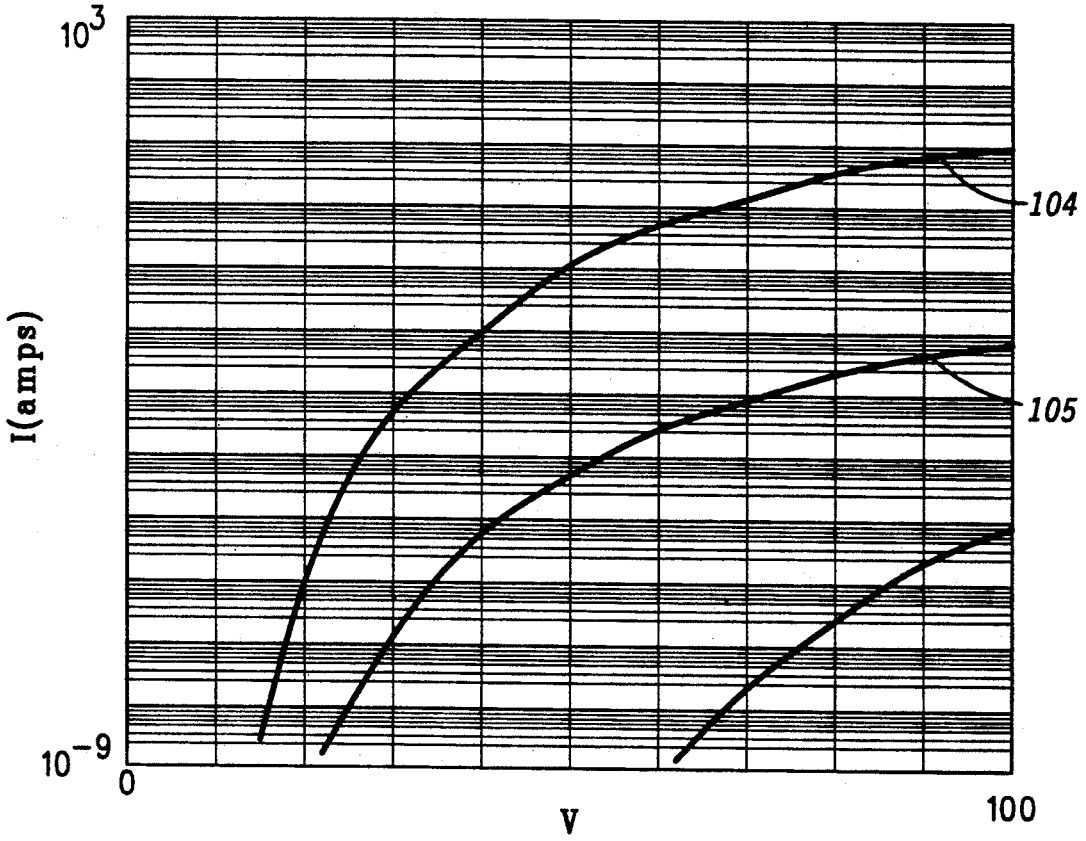

FIG. 14 is an expanded view of the leftmost portion of the graph of FIG. 13 covering the applied voltage range from 0–100 volts. In FIG. 14, a first plot 104 is a graph of a 0–100 volts. In FIG. 14, a first plot 104 is a graph of a calculation for an electron source which employs a material exhibiting a work function of 1eV and a feature with a 500Å radius of curvature. A second plot 105 is a graph of a calculation of an electron source which employs a material with a work function of 5eV and a feature with a 50Å radius of curvature. It is clear from FIG. 14 that an electron emitter formed in accordance with the parameters of first plot 104 provides significantly greater electron current than an electron source formed in accordance with the parameters of second plot 105. From the calculations and illustrations of FIGS. 11–14, it is clear that by employing an electron source, which is formed of a material exhibiting a low surface work function, significant improvements in emitted electron current are realized. It is further illustrated that by employing an electron source with a low surface work function that requirements for a feature of very small radius of curvature are relaxed.

By employing a low work function material such as, for example, type II-B diamond and by providing a polycrystalline surface wherein some exposed crystallographic planes exhibit a low work function preferred crystallographic plane, the requirement that an apex exhibiting a very small radius of curvature be provided may be removed. In embodiments of prior art electric field induced electron emitter devices it is typically found, when considering micro-electronic electron emitters, that the radius of curvature of emitting tips/edges is necessarily less than 500Å and preferentially less than 300Å. For devices formed in accordance with the present invention, substantially planar (flat) polycrystalline diamond film electron sources provide substantially similar electron emission levels as the structures of the prior art. This relaxation of the tip/edge feature requirement is a significant improvement since it provides for dramatic simplification of process methods employed to realize electron source devices.

While particular preferred embodiments of electron devices employing the electron sources of the present invention have been described it is anticipated that other electron device structures employing electron sources which utilize the electrical characteristics of type II-B diamond semiconductor material may be realized and fall within the scope and spirit of the present invention.

What is claimed is:

1. An electron device electron source comprising a polycrystalline diamond film having a surface including a plurality of crystallographic planes some of which exhibit an inherent affinity to retain electrons disposed at/near the surface which is less than 1.0 electron volt.

2. The electron source of claim 1 wherein the preferred crystallographic plane is the 111 crystal plane.

3. An electron device electron source comprising a polycrystalline diamond film having a surface including a plurality of crystallographic planes some of which exhibit an inherent negative affinity to retain electrons disposed at/near the surface of the material.

4. The electron source of claim 3 wherein the preferred crystallographic plane is the 111 crystal plane.

5. An electron device comprising:

a polycrystalline diamond film having a surface including a plurality of crystallographic planes some of which exhibit a very low affinity to retain electrons disposed at/near the surface;

an anode distally disposed with respect to the surface and constructed to have a voltage source coupled between the anode and the polycrystalline diamond film, such that providing a voltage of appropriate polarity between the anode and polycrystalline diamond film results in electron emission from crystallographic planes of the plurality of crystallographic planes exhibiting very low electron affinity which electron emission is substantially uniform and preferentially collected at the anode.

6. The electron device of claim 5 wherein the electron affinity is less than 1.0 electron volt.

7. The electron device of claim 5 wherein the preferred crystallographic plane is the 111 crystal plane.

8. The electron device of claim 5 wherein the anode includes:

a substantially optically transparent faceplate having a major surface;

a substantially optically transparent layer of conductive material disposed on the major surface of the faceplate; and a layer of cathodoluminescent material disposed on the substantially optically transparent layer of conductive material, such that emitted electrons collected at the anode stimulate photon emission in the cathodoluminescent layer to provide a substantially uniform light source.

9. The electron device of claim 5 further including a supporting substrate having a major surface on which the polycrystalline diamond film is disposed.

10. The electron device of claim 9 wherein the supporting substrate includes silicon.

11. An electron device comprising:

a polycrystalline diamond film having a surface including a plurality of crystallographic planes some of which planes exhibit an affinity less than zero electron volts to retain electrons disposed at/near the surface;

an anode distally disposed with respect to the surface; and a voltage source connected between the anode and polycrystalline diamond film resulting in electron emission from crystallographic planes of the plurality of crystallographic planes exhibiting an electron affinity of less than 0.0 electron volts which electron emission is substantially uniform and preferentially collected at the anode.

12. The electron device of claim 11 wherein the preferred crystallographic plane is the 111 crystal plane.

13. The electron device of claim 11 wherein the anode includes:

a substantially optically transparent faceplate having a major surface;

a substantially optically transparent layer of conductive material disposed on the major surface of the faceplate; and a layer of cathodoluminescent material disposed on the substantially optically transparent layer of conductive material, such that emitted electrons collected at the anode stimulate photon emission in the cathodoluminescent layer to provide a substantially uniform light source.

14. An electron device comprising:

a supporting substrate having a major surface;

at least a plurality of electron sources each including a polycrystalline diamond film having a surface comprising a plurality of crystallographic planes some of which exhibit a very low electron affinity at/near the surface;

an anode distally disposed with respect to the plurality of electron sources;

a plurality of conductive paths disposed on the major surface of the supporting substrate and selectively operably coupled to the plurality of electron sources;

a voltage source connected to the anode and a reference potential; and signal means operably applied to the plurality of electron sources and a reference potential, such that electrons are preferentially emitted from at least some electron sources of the plurality of electron sources and collected at areas of the anode substantially corresponding to the area of a selected electron source from which electrons have been emitted.

15. The electron device of claim 14 wherein the electron affinity is less than 1.0 electron volt.

16. The electron device of claim 14 wherein the preferred crystallographic plane is the 111 crystal plane.

17. The electron device of claim 14 wherein the anode includes:

a substantially optically transparent faceplate having a major surface;

a substantially optically transparent layer of conductive material disposed on the major surface of the faceplate; and a layer of cathodoluminescent material disposed on the substantially optically transparent layer of conductive material, such that emitted electrons collected at selected areas of the anode stimulate photon emission in the cathodoluminescent layer to provide an image viewable at the faceplate.

18. An electron device comprising:

a supporting substrate having a major surface;

at least a plurality of electron sources each including a polycrystalline diamond film having a surface comprising a plurality of crystallographic planes some of which exhibit an electron affinity of less than zero electron volts at/near the surface;

an anode distally disposed with respect to the plurality of electron sources;

a plurality of conductive paths disposed on the major surface of the supporting substrate and selectively operably coupled to the plurality of electron sources;

a voltage source connected between the anode and a reference potential; and signal means operably applied to the plurality of electron sources and a reference potential, such that electrons are preferentially emitted from at least some electron sources of the plurality of electron sources and collected at areas of the anode substantially corresponding to the area of a selected electron source from which electrons have been emitted.

19. The electron device of claim 18 wherein the preferred crystallographic plane is the 111 crystal plane.

20. The electron device of claim 18 wherein the anode includes:

a substantially optically transparent faceplate having a major surface;

a substantially optically transparent layer of conductive material disposed on the major surface of the faceplate; and a layer of cathodoluminescent material disposed on the substantially optically transparent layer of conductive material, such that emitted electrons collected at selected areas of the anode stimulate photon emission in the cathodoluminescent layer to provide an image viewable at the faceplate.

* * * * *